US006024365A

United States Patent [19]

Gonella et al.

[11] Patent Number: 6,024,365

[45] **Date of Patent: *Feb. 15, 2000**

[54] BRAKING DEVICE PARTICULARLY FOR SKATES

[75] Inventors: Mario Gonella, Conegliano; Francesco Caeran, Montebelluna, both of Italy

[73] Assignee: Nordica, S.p.A., Montebelluna, Italy

[ * ] Notice: This patent is subject to a terminal disclaimer.

[21] Appl. No.: 08/994,624

[22] Filed: Dec. 19, 1997

Related U.S. Application Data

[63] Continuation of application No. 08/506,577, Jul. 25, 1995, Pat. No. 5,702,113.

[30] Foreign Application Priority Data

Jul. 29, 1994 [IT] Italy ..... TV94A0095

[51] Int. Cl.[7] ..... A63C 17/14

[52] U.S. Cl. ..... 280/11.2; 280/11.2; 188/5

[58] Field of Search ..... 280/11.19, 11.2, 280/11.22, 11.23, 87.041, 87.042, 11.36; 188/5, 6, 7

[56] References Cited

U.S. PATENT DOCUMENTS

| | | | |
|---|---|---|---|
| 5,505,468 | 4/1996 | Pozzobon et al. | 280/11.2 |
| 5,702,113 | 12/1997 | Gonella et al. | 280/11.2 |

FOREIGN PATENT DOCUMENTS

| | | |
|---|---|---|
| 0 567 948 | 3/1993 | European Pat. Off. . |
| 0 585 764 | 3/1994 | European Pat. Off. . |
| 0 594 080 | 4/1994 | European Pat. Off. . |

*Primary Examiner*—Robert J. Oberleitner
*Assistant Examiner*—Pamela J. Lipka
*Attorney, Agent, or Firm*—Hale and Dorr LLP

[57] ABSTRACT

Braking device, particularly for skates that comprise a shoe composed of a quarter articulated to a shell associated with a frame whereto two or more wheels are pivoted. A rod member is connected to the quarter and is slidingly associated at a seat that acts as a guide and is formed on a support associated with the frame.

12 Claims, 3 Drawing Sheets

BRAKING DEVICE PARTICULARLY FOR SKATES

CROSS-REFERENCE TO RELATED APPLICATION

This application is a continuation of Ser. No. 08/506,577, filed Jul. 25, 1995, now U.S. Pat. No. 5,702,113, which is expressly incorporated hereby by reference.

BACKGROUND OF THE INVENTION

The present invention relates to a braking device particularly for skates.

The problem of braking the wheels in order to adjust the speed of the skate is currently felt in conventional roller skates, whether constituted by a shoe associated with a support for two pairs of mutually parallel wheels or for in-line wheels.

It is known to use appropriate blocks or pads, usually made of rubber, which are placed at the toe or heel region of the shoe; when the user tilts the shoe forwards or backwards, the free end of the blocks or pads interacts with the ground and braking is thus achieved.

However, these solutions are not ideal, since they require the user to rotate the shoe, and therefore the frame associated therewith, at the toe or at the heel, which can cause a loss of balance with consequent falls.

U.S. Pat. No. 1,402,010 discloses a roller skate having a band that can be fastened on the user's leg above the malleolar region, a rod being connected thereto.

Said rod surrounds the rear of the leg, is then curved so as to laterally affect said leg and is associated, at its ends, in the malleolar region, with a lever system articulated to a structure protruding from the wheel supporting frame.

Said lever system protrudes at the rear of the frame and is connected to a plate that is shaped approximately complementarily to the curvature of part of an underlying and facing wheel.

The main drawback is that a relative motion occurs between the band and the leg throughout sports practice, which does not make its use comfortable due to the continuous rubbing of the band on the leg.

Furthermore, the plate is activated every time the user bends his leg backwards beyond a given angle, without true and easy possibilities of varying this condition.

Furthermore, each user has a different leg shape, so that braking is achieved at different rotation angles for an equal rod length.

Said rod also acts and presses in the malleolar region, thus causing discomfort or producing accidental impacts.

Finally, the wheel wears rapidly.

U.S. Pat. No. 4,275,895 discloses a brake for skates with two pairs of mutually parallel wheels, which acts at the rear wheels.

Said brake is constituted by a flap associated with the shoe in a rearward position, a blade being associated in a rearward position with said flap and pivoted at the shoe supporting frame.

Said blade has, at its free end, a transverse element whereon two C-shaped elements are formed at the lateral ends, said elements interacting, following a backward rotation applied to the flap, with the rear wheels that face said elements, so as to interact with the rolling surface of said wheels.

However, even this solution has drawbacks: it is in fact structurally complicated and therefore difficult to industrialize; it also requires adapted springs for repositioning the flap in the condition wherein the two C-shaped elements do not interact with the wheels, and this further increases structural complexity.

Furthermore, the structural configuration of the brake causes the two C-shaped elements to interact with the wheel even upon a minimal backward rotation applied to the flap and consequently even for involuntary movements, thus producing undesired braking actions and, accordingly, possible losses of balance or lack of coordination.

Finally, the interaction of the C-shaped element at the rolling surface of the wheels leads to their rapid wear and therefore to non-optimum rolling, which necessarily entails continuous replacement of said wheels.

U.S. Pat. No. 4,300,781 discloses a braking device for skates having pairs of mutually parallel wheels.

The device comprises a brake constituted by a blade that is pivoted transversely at the rear end of the shoe supporting frame; pads are associated with the ends of said blade and face the rolling surface of the pair of rear wheels.

The brake is activated by using a cable adapted to rotate the blade in contrast with a spring that is associated with the support for the pair of front wheels, so as to move the pads into contact with the rolling surface of the pair of rear wheels.

Said cable can be activated by means of rings or handles associated with a band that can be placed on the user's legs by virtue of temporary connection means.

However, this solution has considerable drawbacks; first of all, brake activation can lead to possible losses of balance because the user's body does not assume a correct position for controlling the sudden speed reduction; only the skater's hand is in fact involved in the activation of the brake.

Furthermore, if the skater is wearing trousers, when traction is applied to the rings the band may slip along the trousers or make them slide along the leg, hindering the braking action.

Furthermore, there is a loose cable that, in addition to being a hindrance to the skater, can accidentally catch during skating, especially since coordination of the arm-leg movement moves the legs rhythmically laterally outwards.

U.S. Pat. No. 4,033,596 discloses a roller-ski having braking means in addition to engagement means for the tip of a shoe. The braking means are substantially constituted by a bar protruding above a shoe supporting frame in the rear region thereof, said bar being pivoted transversely to said frame at one end and having, at the other end, a curved plate for supporting the user's calf.

A frame is associated transversely and to the rear with respect to the bar; once the bar has been rotated backwards, said frame interacts with the rolling surfaces of two wheels that are in turn freely pivoted to the shoe supporting frame.

If this brake is used for roller skates, severe drawbacks arise due to the fact that the sport practiced with a skate entails continuous oscillations of the leg that can lead to undesired activation of the braking action.

Moreover, the presence of the bar would be dangerous for the user, since it constitutes a blunt body, completely independent of the leg, which might therefore be dangerous in a fall.

Furthermore, the described solution does not allow to achieve a gradual braking action.

European Patent Application No. 93106636.9 discloses a braking device particularly for skates that comprise a shoe composed of a quarter articulated to a shell associated with a supporting frame for one or more wheels.

Said braking device comprises at least one rod member connected to the quarter and slideable with respect to the shell, said rod member having a fork-like end that interacts with one or more of the wheels beyond a presettable angle of backward rotation of the quarter.

Although this solution is undoubtedly an improvement and is valid, it has some minor drawbacks related to the fact that it is not possible to easily achieve a good graduality in the braking action, since this is mainly entrusted to the user's skill and sensitivity; the fork may furthermore jam or deform during the braking action.

SUMMARY OF THE INVENTION

The aim of the present invention is therefore to solve the described technical problems, eliminating the drawbacks described above in conventional and providing a braking device that is structurally very simple, easy to industrialize, and does not jam when actuated.

Within the scope of the above aim, an important object is to provide a braking device the user can activate in case of actual need, therefore not accidentally, at the same time protecting the components from any deformations during use.

Another object is to provide a device that, in addition to the preceding characteristics, is reliable and safe in use, has low manufacturing costs, and can also be applied to conventional skates.

This aim, these objects, and others which will become apparent hereinafter are achieved by a braking device, particularly for skates comprising a quarter articulated to a frame, at least one rod member being connected to said quarter, characterized in that said at least one rod member is slidingly associated at a seat that acts as a guide and is associated with said frame, said at least one rod member being operatively connected to a brake that interacts with the ground when said quarter is rotated backwards.

BRIEF DESCRIPTION OF THE DRAWINGS

Further characteristics and advantages of the present invention will become apparent from the following detailed description of some particular embodiments thereof, illustrated only by way of non-limitative example in the accompanying drawings, wherein.

DESCRIPTION OF THE PREFERRED EMBODIMENTS

Figure 1:
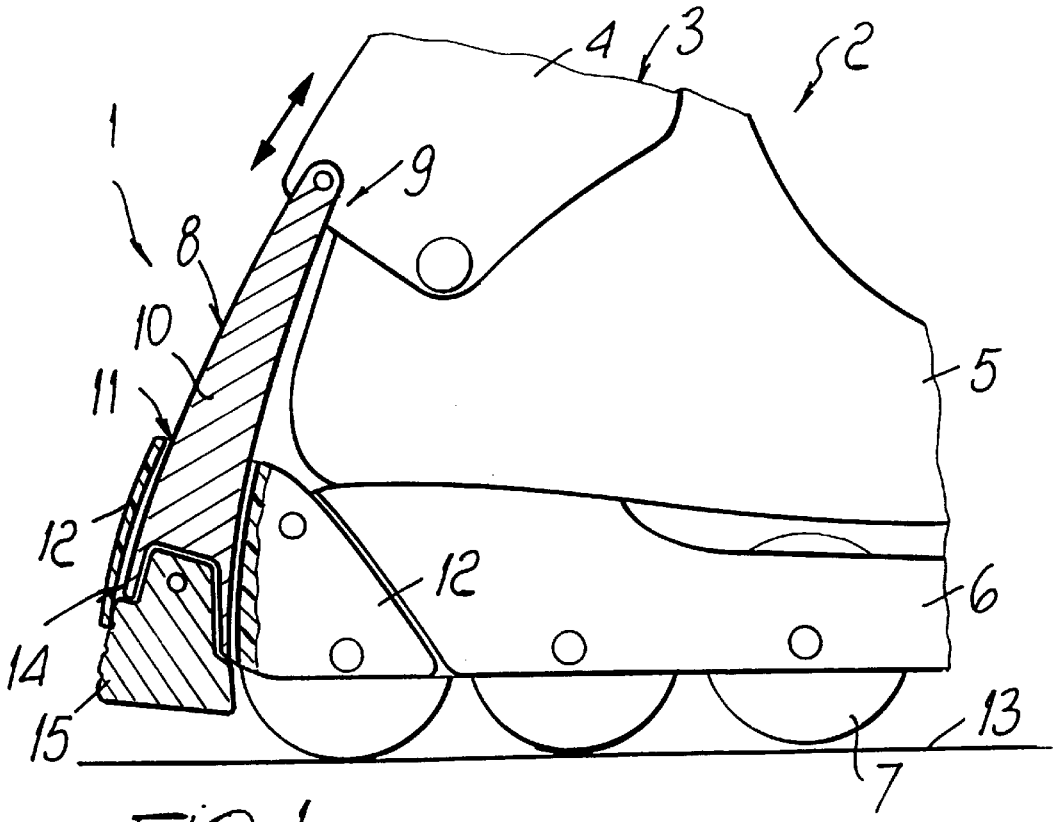
FIG. 1 is a side view of the braking device associated with the skate in the inactive condition.

With reference to the above figures, the reference numeral 1 designates the braking device for a skate 2, which comprises a shoe 3 composed of a shell 4 surrounding the rear lateral region of the user's leg and articulated to a shell 5.

A U-shaped frame 6 is associated below said shell, and two or more wheels, designated by the reference numeral 7, are pivoted between the wings of said frame, said wheels being optionally mutually aligned.

Conventional levers for fastening the quarter 4 and the shell 5 are applied.

The braking device comprises at least one curved rod member 8, a first end 9 whereof is pivoted to the rear and transversely with respect to the quarter 4.

The rod member 8 has a body 10 slidingly associated at a seat 11 that acts as a guide and is formed to the rear on said frame 6 or on a support 12 rearwardly associated with said frame and protruding therefrom.

The seat 11 is formed axially with respect to the support 12 and has a slightly curved shape, so as to allow, when the quarter is rotated backwards, the free and guided sliding of the body 10 towards the ground 13 without causing deformations or jamming.

A brake 15 is preferably rotatably associated with the second end 14 of the rod member 8 and is constituted by a pad adapted to interact with the ground 13 and accommodatable, partially or not, within the seat 11.

The use of the invention is as follows: during normal skating, the quarter 4 can oscillate somewhat without the motion, transmitted to the rod member 8, causing the brake 15 to interact with the ground.

The rod member forces the brake to interact with the ground only upon a given backward rotation of the quarter, and therefore beyond a preset or presettable angle.

The fact that the rod member slides within the seat 11 formed in the support 12 gives said element greater structural strength which, in view of the lack of deformations or jamming, ensures an optimum interaction of the brake with the ground and thus an optimum braking action.

It is thus evident that the invention has achieved the intended aim and objects, a braking device having been obtained that is structurally very simple and wherein brake activation ensures a stable, continuous, and safe braking action without jamming, deformations, or vibrations.

Furthermore, since the rod member is guided within the support, during use it does not undergo deformations caused by the force acting on the brake when it interacts with the ground.

The device according to the invention is susceptible of numerous modifications and variations, all of which are within the scope of the same inventive concept.

Figure 2:
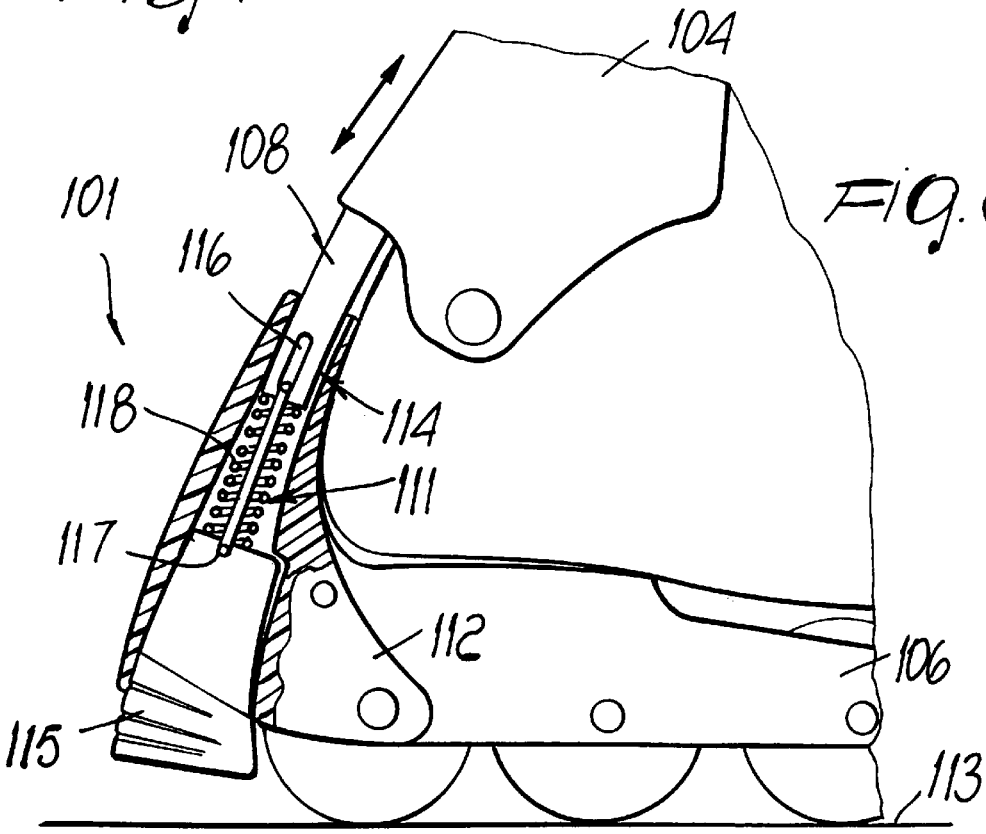
FIG. 2 is a side view of a further embodiment of the braking device in the inactive condition.
Figure 3:
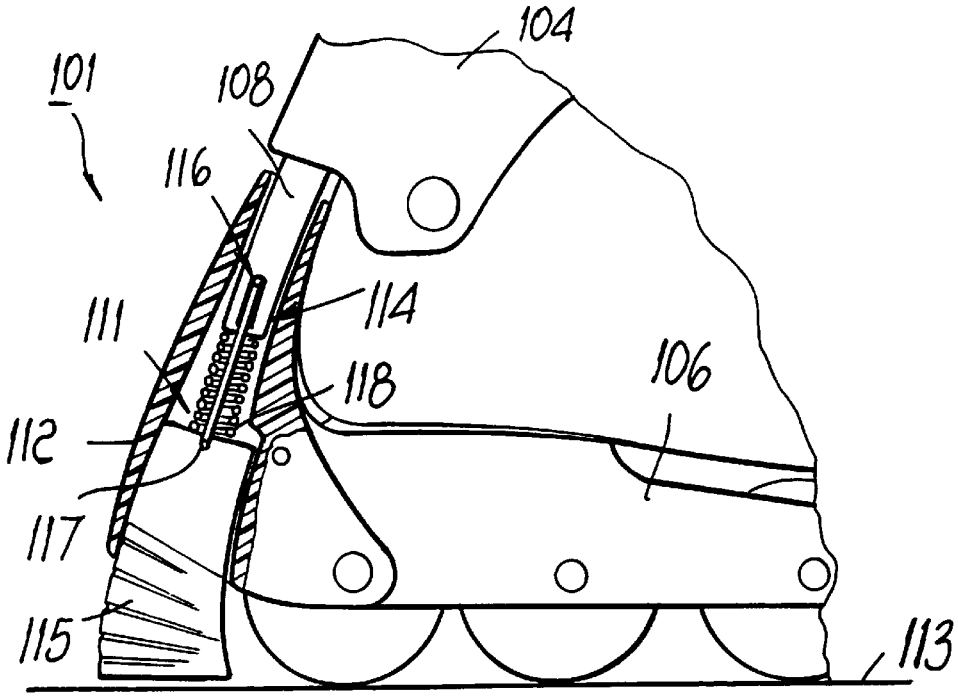
FIG. 3 is a view of the embodiment of FIG. 2 in the active condition.

Thus, for example, in FIGS. 2 and 3 the reference numeral 101 designates the braking device, which comprises at least one slightly curved rod member 108 protruding to the rear and longitudinally with respect to the quarter 104 towards the ground 113.

The rod member 108 has a second end 114 slidingly associated at a seat 111 that acts as a guide and is formed to the rear on said frame 106 or on a support 112 rearwardly associated with said frame and protruding therefrom.

The seat 111 is formed axially with respect to the support 112 and is slightly curved, so as to allow, when the quarter is rotated backwards, the free and guided sliding of the rod member 108 towards the ground 113 without deformations or jamming.

A slot 116 is formed longitudinally on the second end 114 of the rod member 108 and acts as a seat for the end of an element, such as a cable or ring 117, for connection to the brake 115.

Said cable or ring is in fact associated, at its ends, with said slot and with said brake.

A flexible element is arranged coaxially to said cable or ring 117 or in a region adjacent thereto, said flexible element being for example constituted by a cylindrical helical compression spring 118, the ends whereof abut against said rod member and said brake.

Figure 4:
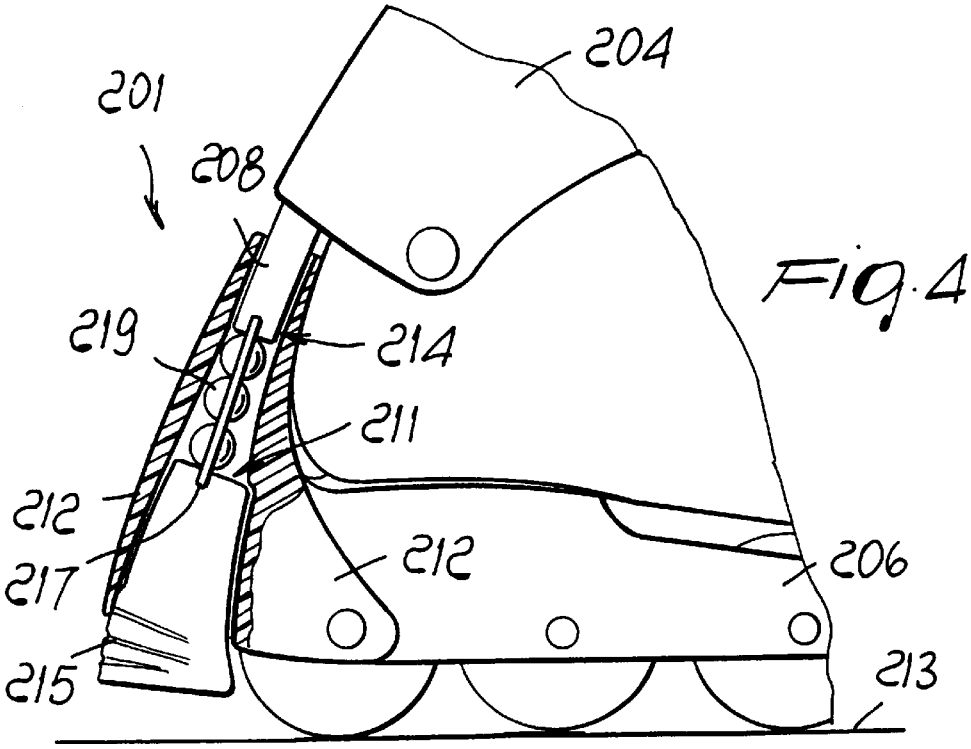
FIG. 4 is a side view of still a further embodiment of the braking device in the inactive condition.
Figure 5:
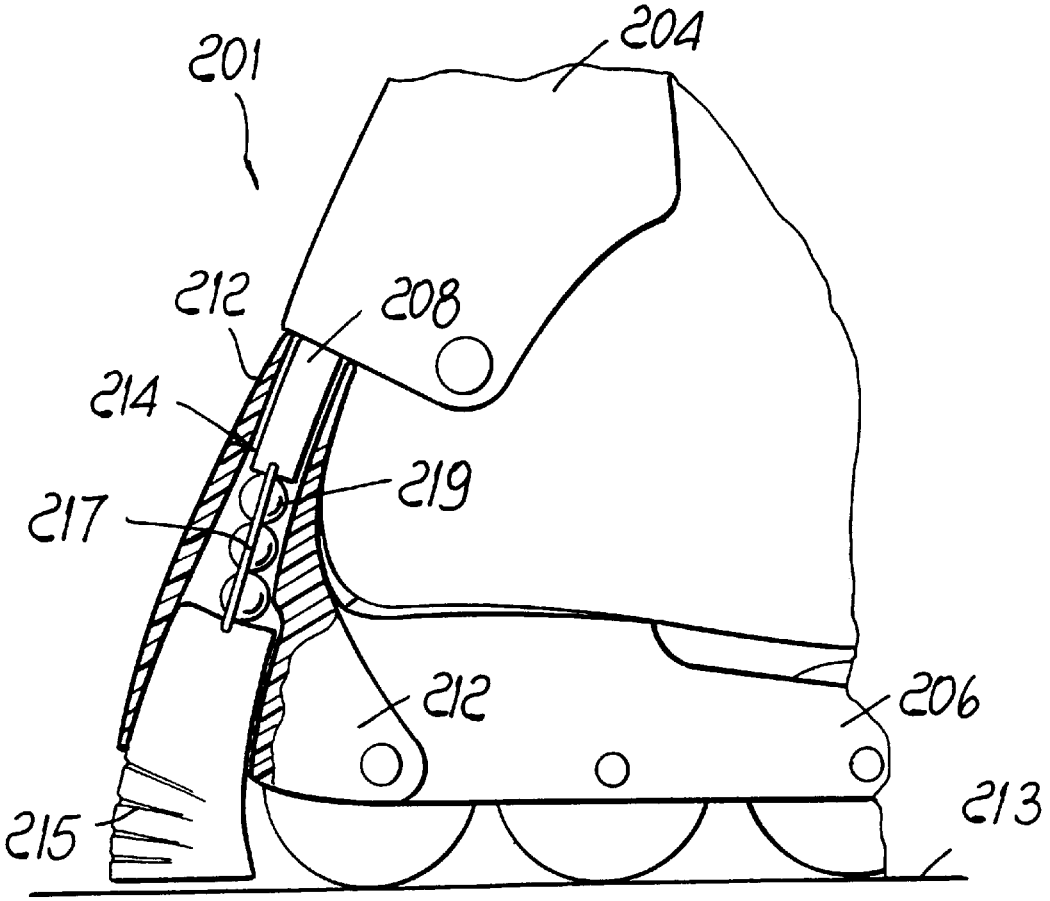
FIG. 5 is a view of the embodiment of FIG. 4 in the active condition.

In FIGS. 4 and 5, the reference numeral 201 designates the braking device, which comprises at least one slightly curved rod member 208 protruding to the rear and longitudinally with respect to the quarter 204 towards the ground 213.

The rod member 208 is provided with a second end 214 slidingly associated at a seat 211 that acts as a guide and is formed to the rear on said frame 206 or on a support 212 rearwardly associated with said frame and protruding therefrom.

The seat 211 is formed axially with respect to the support 212 and has a slightly curved shape so as to allow, when the quarter is rotated backwards, the free and guided sliding of the rod member 208 towards the ground 213 without deformations or jamming.

The end of an element, such as a cable or ring 217, for connection to the brake 215, is associated with the second end 214 of the rod member 208.

Said cable or ring is in fact associated, at its ends, with said second end and with said brake.

The braking device comprises means for compensating for the variation in the direction of the forces applied to the rod member 208 and to the brake 215, said means being constituted by at least one ball 219 interposed between the second end 214 and the brake 215.

In the particular illustrated embodiment there are three balls, the function whereof is to allow, as the direction of the force applied by the rod member 208 varies during brake activation, to compensate for the difference between the direction of the pressing force of the quarter 204, and therefore of the rod member 208, and the direction of the force to be applied to the brake 215.

The three balls, as they can roll with respect to each other and can move inside the seat 211, perform a self-centering movement.

All the described components can of course be replaced with other mechanically equivalent ones; thus, for example, the support 12, 112, 212 can be associated with the shell instead of with the frame, achieving the same result.

Furthermore, the materials and the dimensions constituting the individual components of the braking device may be the most pertinent according to the specific requirements.

We claim:

1. In a skate of the type including a quarter articulated to a frame and a braking device arranged to engage the ground in response to rearward articulation of said quarter relative to said frame, the braking device comprising a generally vertical actuator having an upper end portion and a lower end portion, said actuator being moveable generally upward and downward relative to said frame in response to articulation of said quarter, that improvement comprising:

a generally vertical longitudinally-extending guide mounted to the rear of said skate, said guide defining a seat having generally vertical forward and rearward facing surfaces, a portion of said actuator being positioned within said seat and having respective generally vertical surfaces arranged to slidably engage said surfaces of said seat such that said actuator is slidably movable upwardly and downwardly relative to said guide in response to articulation of said quarter relative to said frame.

2. The braking device of claim 1 wherein said surfaces of said guide are curved longitudinally of said guide.

3. The braking device of claim 1 wherein said actuator includes a rod member having the upper end thereof being associated with said quarter.

4. The braking device of claim 1 including a compensator arranged to compensate for variations in directions of force applied by said actuator.

5. The braking device of claim 4 wherein said compensator includes at least one ball disposed adjacent the lower end portion of said actuator for compensating for the variation in the direction of the forces applied by the lower end portion.

6. The braking device of claim 5 wherein said compensator includes at least two said balls in contact with each other.

7. The braking device of claim 1 wherein said seat is formed axially with respect to said guide and has a slightly curved shape so as to allow, when said quarter is rotated backwards, free and guided sliding of said actuator downwardly towards a ground surface.

8. The braking device of claim 1 wherein a brake device is rotatably associated with a lower end of said actuator, and comprises a pad adapted to interact with the ground.

9. The braking device of claim 1 wherein said actuator includes an upper portion having a slot formed longitudinally in a lower end thereof and a lower element having the upper end thereof seated within said slot.

10. The braking device of claim 9 wherein a compression member is arranged coaxially to said lower element with an upper end of said compression member abutting against said upper portion.

11. The braking device of claim 9 wherein said lower element is one of a cable and a ring.

12. The braking device of claim 9 wherein the lower end of said lower element is attached to a brake device.

* * * * *